US006872889B1

(12) United States Patent
Cruttenden et al.

(10) Patent No.: US 6,872,889 B1
(45) Date of Patent: Mar. 29, 2005

(54) SNATCH DISCONNECTION LANYARD

(75) Inventors: Michael James Cruttenden, Hove (GB); Dennis Griffin, Guildford (GB)

(73) Assignee: EDO MBM Technology Limited, Brighton (GB)

( * ) Notice: Subject to any disclaimer, the term of this patent is extended or adjusted under 35 U.S.C. 154(b) by 0 days.

(21) Appl. No.: 09/869,867

(22) PCT Filed: Jan. 11, 2000

(86) PCT No.: PCT/GB00/00141

§ 371 (c)(1),
(2), (4) Date: Oct. 8, 2001

(87) PCT Pub. No.: WO00/42681

PCT Pub. Date: Jul. 20, 2000

(30) Foreign Application Priority Data

Jan. 11, 1999 (GB) ..... 9900543

(51) Int. Cl.[7] ..... H01B 7/06
(52) U.S. Cl. ..... 174/69; 254/368
(58) Field of Search ..... 174/19, 69; 254/368, 254/375, 903

(56) References Cited

U.S. PATENT DOCUMENTS

| | | | | |
|---|---|---|---|---|
| 3,609,632 | A | 9/1971 | Vetter | |
| 4,134,634 | A | 1/1979 | Bauer et al. | |
| 4,691,941 | A | 9/1987 | Rabushka et al. | |
| 6,149,132 | A * | 11/2000 | Ostrobrod | 254/368 |
| 2002/0030133 | A1 * | 3/2002 | Ratzlaff | 242/388.6 |

FOREIGN PATENT DOCUMENTS

| | | |
|---|---|---|
| DE | 9406232.3 | 7/1994 |
| EP | 0526294 | 2/1993 |
| GB | 2249776 | 5/1992 |

* cited by examiner

*Primary Examiner*—Chau N. Nguyen
(74) *Attorney, Agent, or Firm*—Dean W. Russell; Kilpatrick Stockton LLP

(57) ABSTRACT

A snatch connector is provided with a disconnection lanyard assembly including a tensioner assembly including a spreader bar, cables, and a cable reel. The reel may be set to allow paying out of the cable or to pull in the cable and when set to pull in, will resist paying out of the cable, thereby providing a tensile force for snatch disconnection.

11 Claims, 8 Drawing Sheets

SNATCH DISCONNECTION LANYARD

FIELD OF THE INVENTION

This invention relates to snatch connectors providing connection/disconnection of electrical or fluid circuits extending between two separable bodies. For example a snatch connector may be employed to connect a refrigeration unit or charging circuit on a road vehicle to a fixed (stationary) power supply, ensuring safe disconnection of the electrical power if the vehicle is inadvertently driven away without first manually disconnecting the circuit. Other applications for snatch connectors include:

1) connecting ship to shore service lines
2) emergency disconnect packages, connectors and interfaces for ROV (remote operated vehicle) manipulation, used in subsea oil and gas production
3) electrical connections for loads dropped or ejected from aircraft or other moving vehicles.

BACKGROUND OF THE INVENTION

It is necessary for these connectors to be positively and safely separated to avoid damage to the electrical/fluid circuit and its anchoring points on the separated bodies. This function is normally achieved by firmly securing a first half of the connector to a first one of the bodies and fitting the second half of the connector at the end of a flexible cable or conduit leading to the second body. A lanyard loop is then secured between a fixed strong-point on the second body and the connector second half, so that as the bodies separate, the lanyard is tensioned and releases a spring loaded coupling slave on the connector, thereby allowing the two halves to separate. The length of the lanyard loop is shorter than the cable or conduit, which is therefore not subjected to excessive strain as the connector halves are pulled apart.

A similar arrangement is disclosed in U.S. Pat. No. 4,134,634 (Bauer et al), which concerns a tow cable connector for helicopters, in which a fixed lanyard is used. The tow cable is paid out from a winch. When winch torque is overcome, the cable extends and the lanyard releases the tow connector.

In DE-U-9406232.3 (Erich Jaeger) a snatch connector is shown, having a connector latch linked to a coiled part of a connecting cable, using a fixed length lanyard. Stretching of the coiled part pulls the lanyard taut and releases the connector latch.

In some applications, for example where the first body is a variable load releasable from an aircraft, the second connector half may have to co-operate with a variety of different first connector halves, in various different connected positions, for different loads. In such cases it can be difficult to fit the lanyard to ensure proper disconnection whatever the load. Depending upon the type of load it may prove necessary to change the length of the lanyard and the location of the strong-point, entailing major structural changes to the aircraft. It may also be important to provide for stowage of the cable/conduit and lanyard after separation of the connector halves, e.g. to prevent damage in a vehicle's slipstream or by dragging on the ground.

SUMMARY OF THE INVENTION

The present invention provides a snatch disconnection lanyard assembly comprising a tensioner characterised in that the tensioner may be set to allow paying out of the lanyard or set to pull in the lanyard and when set to pull in, will resist paying out of the lanyard, thereby providing a tensile force for snatch disconnection. To allow the lanyard and an associated connector half to be coupled to a co-operating connector half in a variety of different possible positions, the tensioner is set to allow paying out the lanyard. Preferably when so set, pulling in of the cable by the tensioner is resisted, maintaining slack in the lanyard for ready mating of the connector halves. Once the connection has been made up, the tensioner can be set to pull in, whereupon the slack in the lanyard is taken up and the lanyard is maintained under slight tension. This tension is however designed to be at a level insufficient to separate the connector halves. Then when the tensioner, lanyard and its associated connector half are moved bodily away from the other connector half, paying out of the lanyard is resisted and tension in the lanyard increases to the point where the connector halves are pulled apart.

Where for example the connector halves are respectively attached to a vehicle and its load, because the lanyard is maintained under tension, inertial movements of the load relative to the vehicle or aerodynamic forces acting on the load could cause premature disengagement of the connector. To help prevent this, a resilient link is connected to the lanyard, opposed parts of the link each carrying abutment faces, the respective abutment faces on either side being brought into contact with each other when the link has been deformed by a predetermined amount, thereby increasing the stiffness of the link and allowing transmission of snatch disconnection forces. The link allows limited relative movement of the vehicle and its load prior to engagement of the abutments.

Preferred features of the invention are in the dependent claims and also in the following illustrative description, made with reference to the drawings in which:

DETAILED DESCRIPTION

Figure 1:
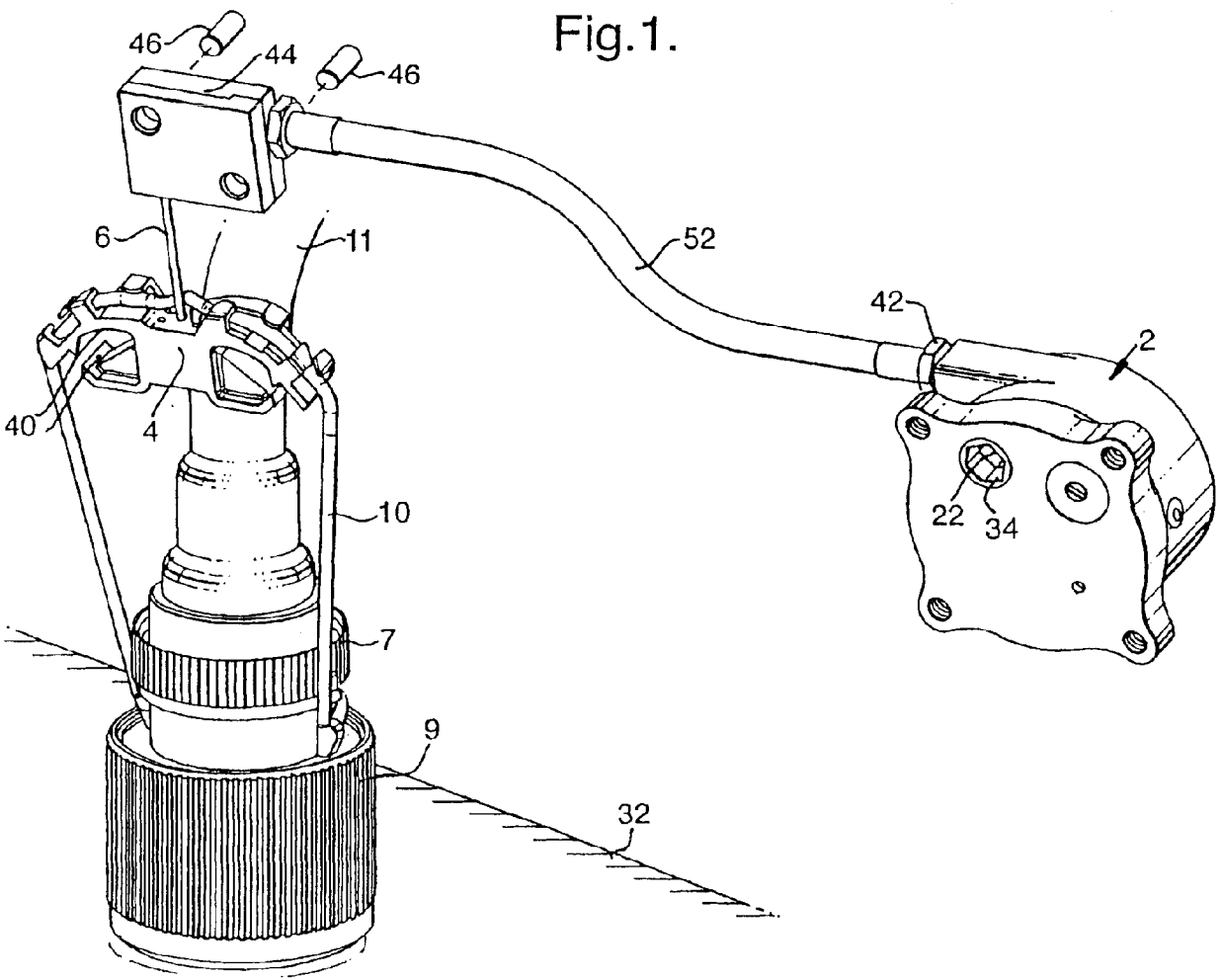
FIG. 1 is a perspective view of a snatch disconnection lanyard assembly embodying the invention.
Figure 2:
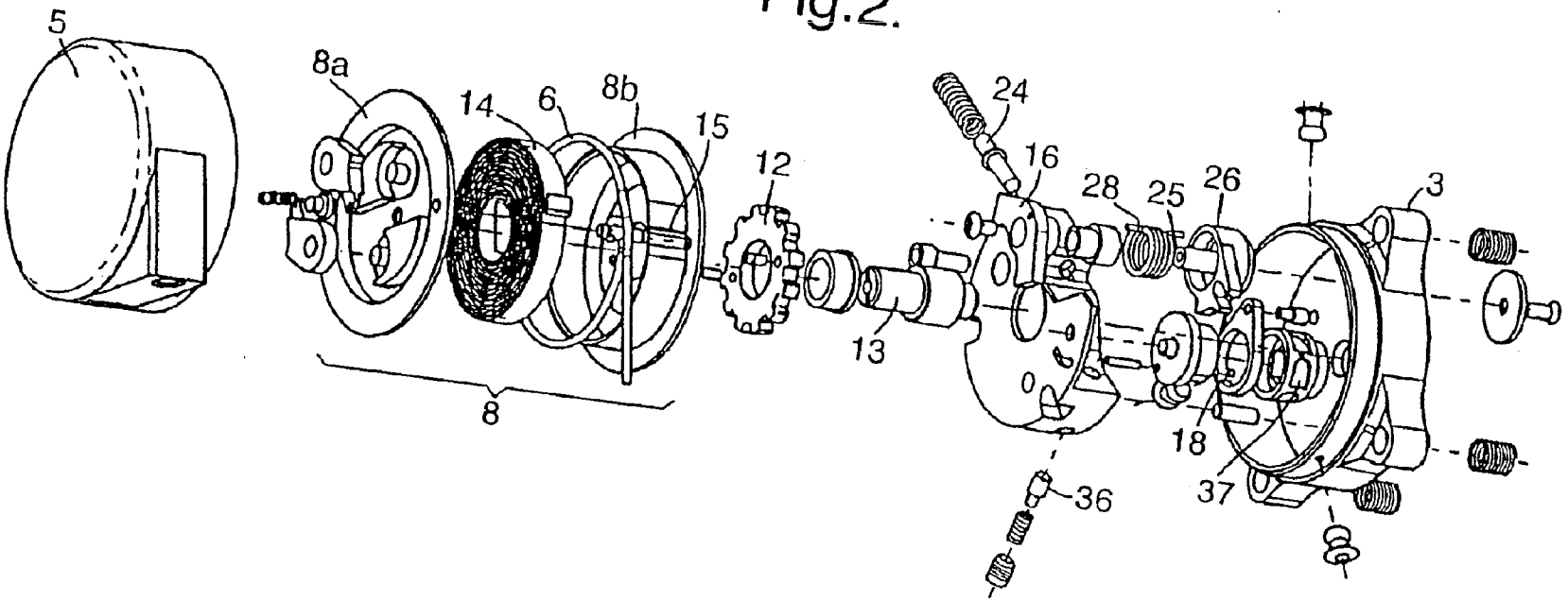
FIG. 2 is an exploded perspective view of a cable reel housing of the lanyard assembly of FIG. 1, and its internal components.

Referring to FIGS. 1 and 2 the tensioner assembly comprises a spreader bar (4) on a miniature wire rope, or cable (6), which is attached to a reel (8, FIG. 2 formed from two halves **(8*a*, 8*b*) within a housing (2). As shown in FIG. 2 the, housing includes a base (3) and a cover (5). The spreader bar ensures that the connector snatch lanyard (10) is tensioned substantially parallel to its disengagement direction. This approach ensures minimal snatch disengagement forces and maximum snatch lanyard life. Ends, of the lanyard (10) are connected at diametrically opposed positions to a connector half (7). A complementary mating connector half (9) is firmly mounted to a releasable load (32). The connector half (9) is fixed to the end of a flexible wiring harness (11)**.

As best seen in FIG. 2, the reel (8) is rotationally spring loaded by a coiled 'clockspring' (14) extending between a fixed spindle (13) and a reel slot (15). Thus the cable (6) is normally under tension as the spring attempts to wind it further onto the reel. It will be apparent that the cable cannot act as a fixed anchor-point unless the reel is prevented from rotating in the reverse direction. This function is provided by an escapement pawl, or latch, (16) which engages with a toothed wheel (12) rigidly coaxially attached to the reel.

The escapement latch is designed to be spring biased in either direction, dependent on the rotational position of a manually operated lever (18) which is rotated by a hexagonal key (20, FIG. 7) inserted into a matching socket (22) in the lever's shaft. In the position shown in FIG. 3, the reel will allow cable to be paid out from the reel with the latch preventing its return; whereas in FIG. 4, the spring tension is applied to the cable, and the reel will resist any attempt to pull out more cable. This latter role provides the desired anchor-point function. The lever is biased to the FIG. 4 position by a spring loaded plunger (24) acting on a horn (25) formed on the latch housing (26). The latch housing has, between it and the latch, a torsion spring (28) which provides the spring compliance necessary to allow the latch to be bypassed in one direction at a time, depending on the position of the manually operated lever. In effect, this provides the function of a ratchet which may be set to operate in either direction.

Figure 3:
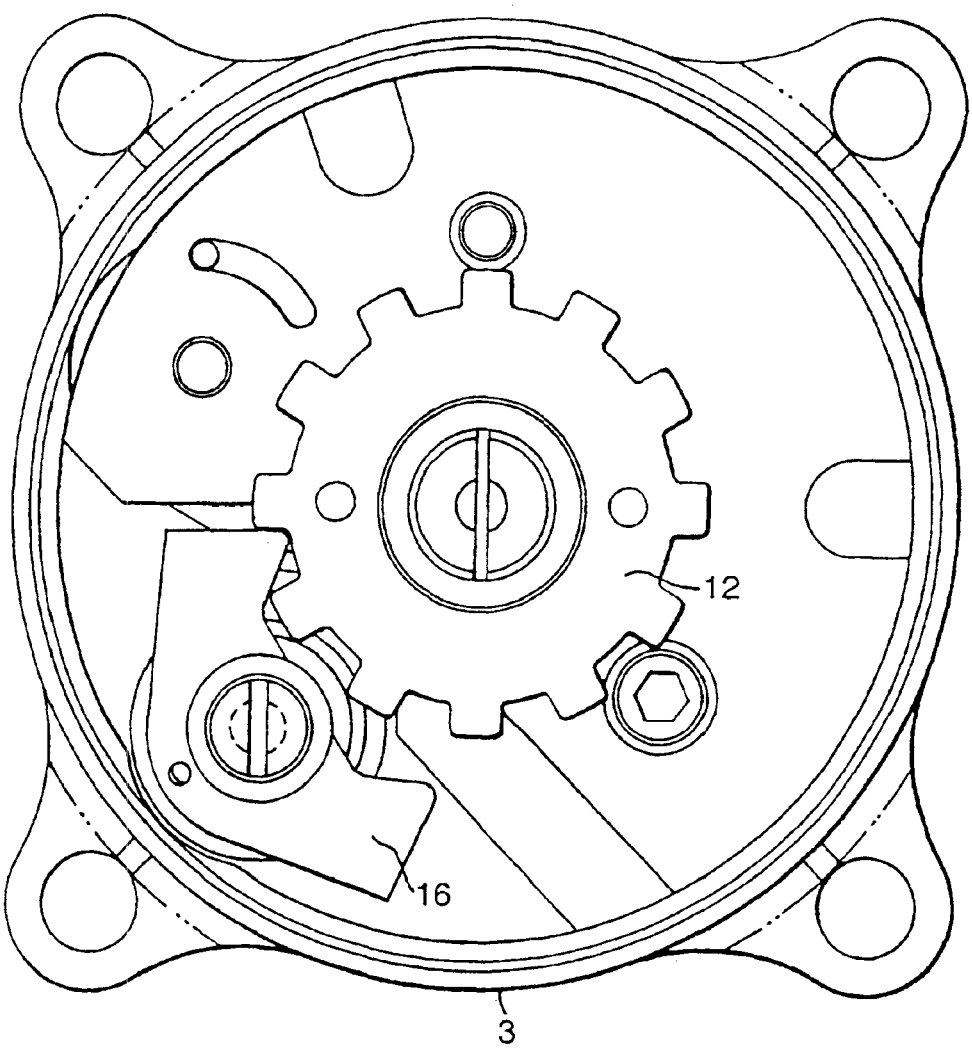
FIG. 3 is a plan view of the cable reel ratchet mechanism in its set condition.
Figure 4:
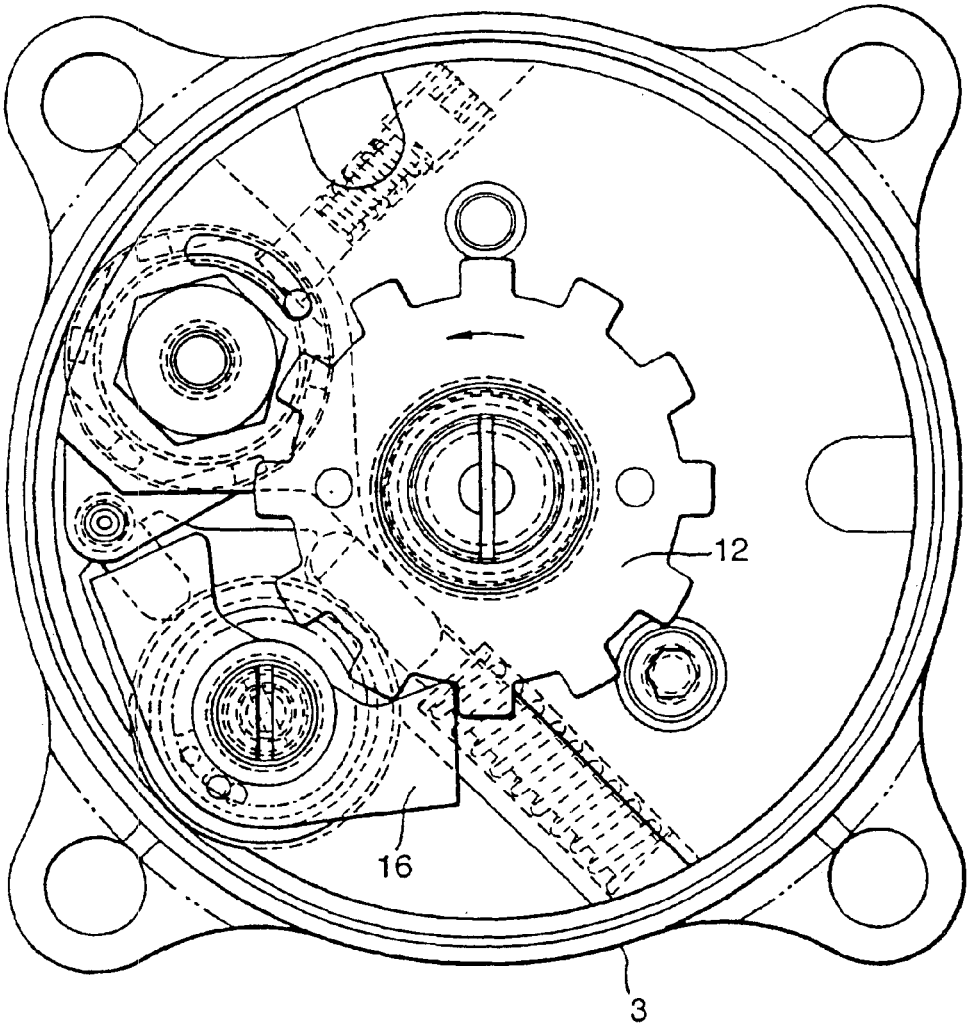
FIG. 4 is a plan view of the cable reel ratchet mechanism in its reset condition.
Figure 5:
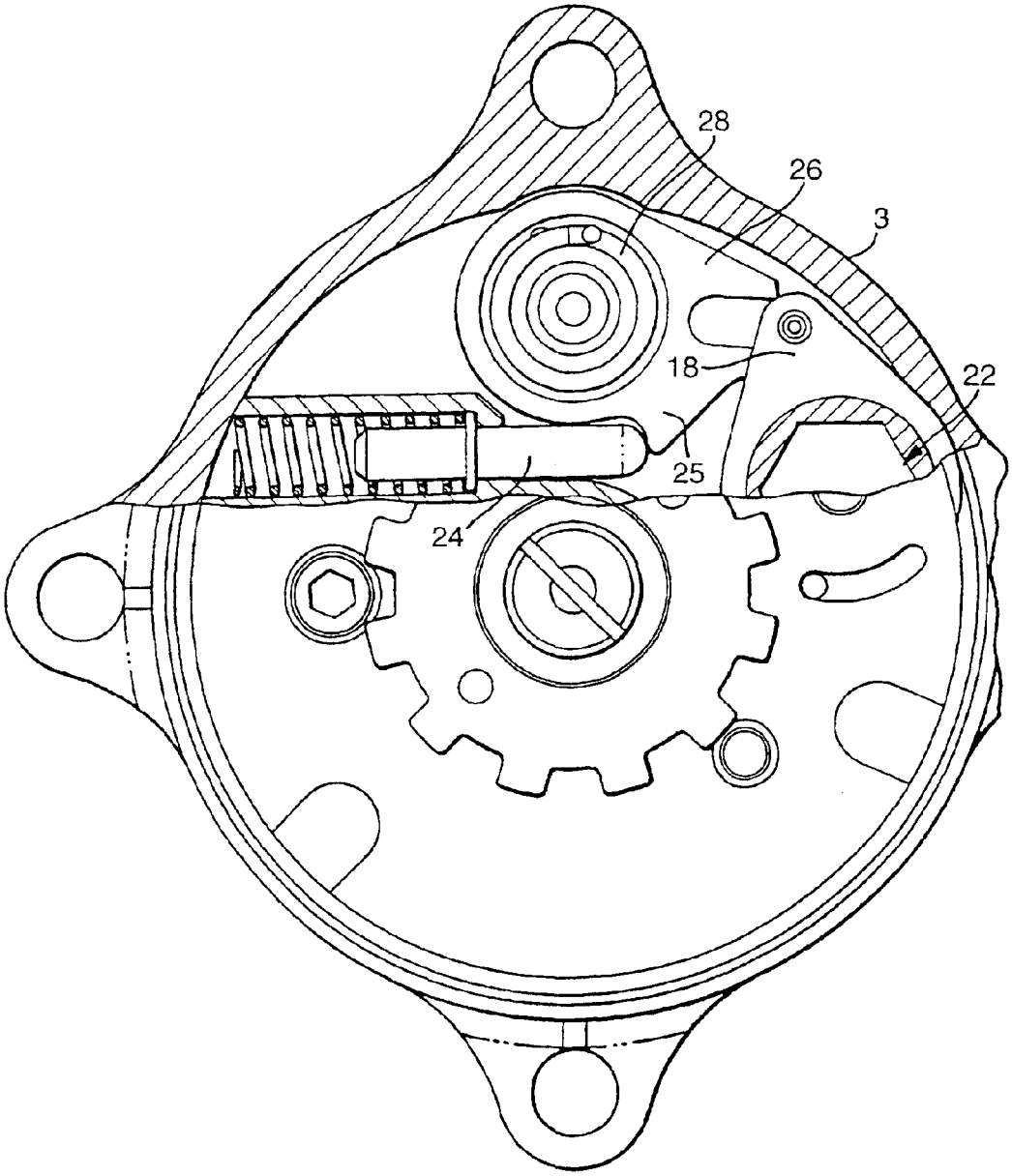
FIGS. 5 and 6 show additional details of the ratchet mechanism.
Figure 6:
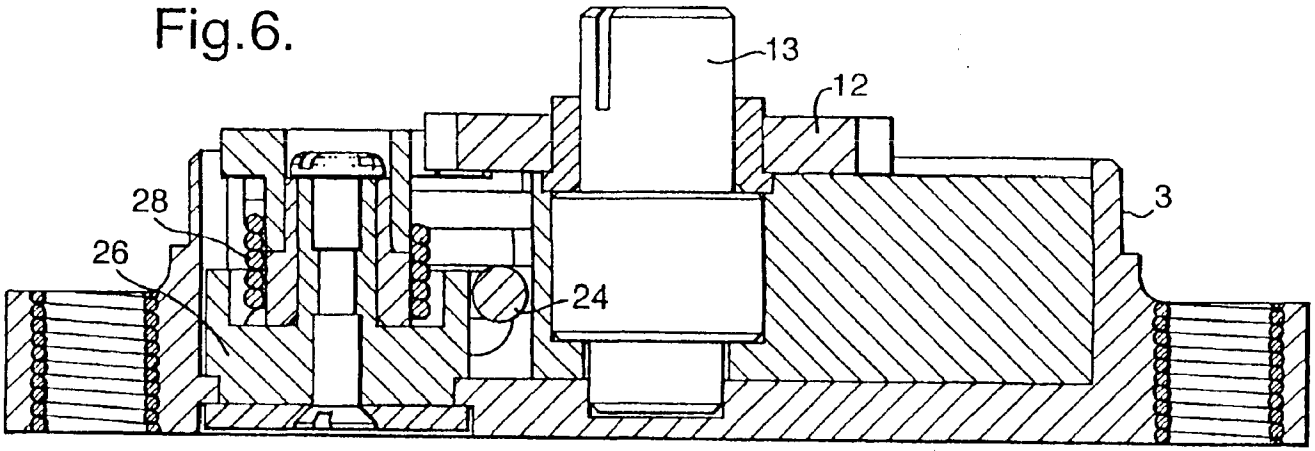

It will be apparent that the FIG. 3 position of the latch is useful for allowing the flexible wiring harness and its attached connector half to be pulled out of its storage position, for example from a pylon suspended beneath an aircraft, and attached to the other connector half (9) fixed to the load (32). Should the operator inadvertently release the wiring harness during this process but prior to attachment to the load, the harness will not retract back into the pylon. The FIG. 3 position of the latch can only be obtained by full insertion of the key into the hexagonal socket (22) in the operating lever, followed by clockwise rotation of the key and lever (viewed from the key access point).

A detent action on the key prevents reverse rotation of the lever when the key is inserted and turned. This function is achieved by means of a separate collar (34) axially coincident with the operating lever, and featuring a matching key socket.

The collar can only be rotated in one direction (clockwise), and is prevented from rotating in the opposite direction by a slidable spring loaded pin (36) which engages a series of wedge shaped recesses (37) machined in the periphery of the collar. So long as the key is rotated and left in place, the latch will therefore remain biased to the paying out mode.

Once the wiring harness has been attached to the load, the key is removed from the socket in the operating lever, and this action allows separate rotation of the lever relative to the collar, and enables the latch to return to the position in which it allows the clockspring to apply a retraction tension to the cable, and at the same time to prevent any pay-out of cable. Thus the fully installed wiring harness is held in place, and the cable then acts as a strong point, disconnecting the snatch connector in the event of downward motion of the connector during load release.

In order to prevent inadvertent disconnection which might be caused by normal aerodynamically and/or inertially induced load movements which routinely occur during captive carriage, the cable termination spreader (4) is designed to flex slightly, allowing a small amount of downward load movement before becoming substantially rigid and transferring disconnection loads to the lanyard. This effect is obtained by shaping the spreader so that it may bend under nominal lanyard tensions until abutment faces (40) contact each other, whereupon a sudden increase in bending stiffness occurs. In one embodiment of the concept, this contact, and its consequential stiffening effect, are designed to occur at approximately 5 mm of downward movement of the lanyard ends, but this principle may be employed to suit other particular requirements.

To provide optimum versatility of location of the reel assembly relative to the wiring harness and connector halves, the cable in the preferred embodiment is slidably contained within a flexible sheath (52), in the manner of a bicycle brake cable, so that it may be routed past obstacles without risk of chafing. In this application, the sheath is terminated by an abutment (42) at the reel housing and a load bearing bracket, or strong-point (44) which is firmly attached to the pylon structure by removable pins (46) which enable its position to be re-sited to align with different load connector positions.

Figure 7:
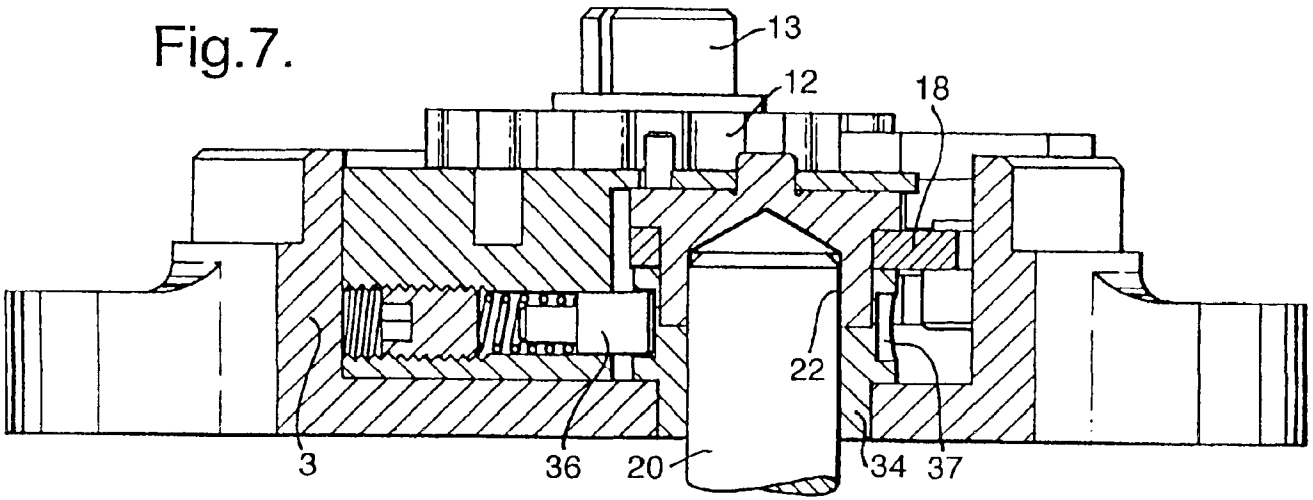
FIG. 7 shows a hexagonal key hole and an associated further ratchet mechanism.
Figure 8:
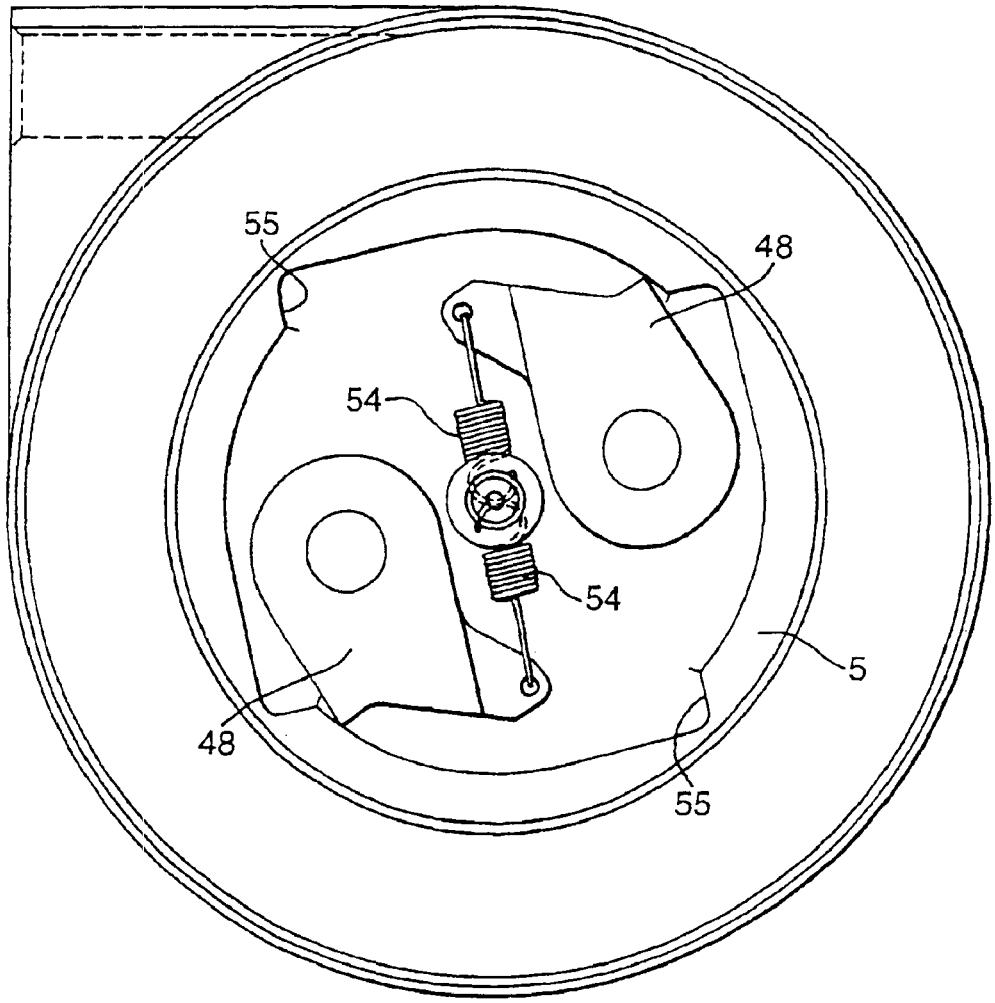
FIGS. 8 and 9 show a centrifugal brake for the reel.
Figure 9:
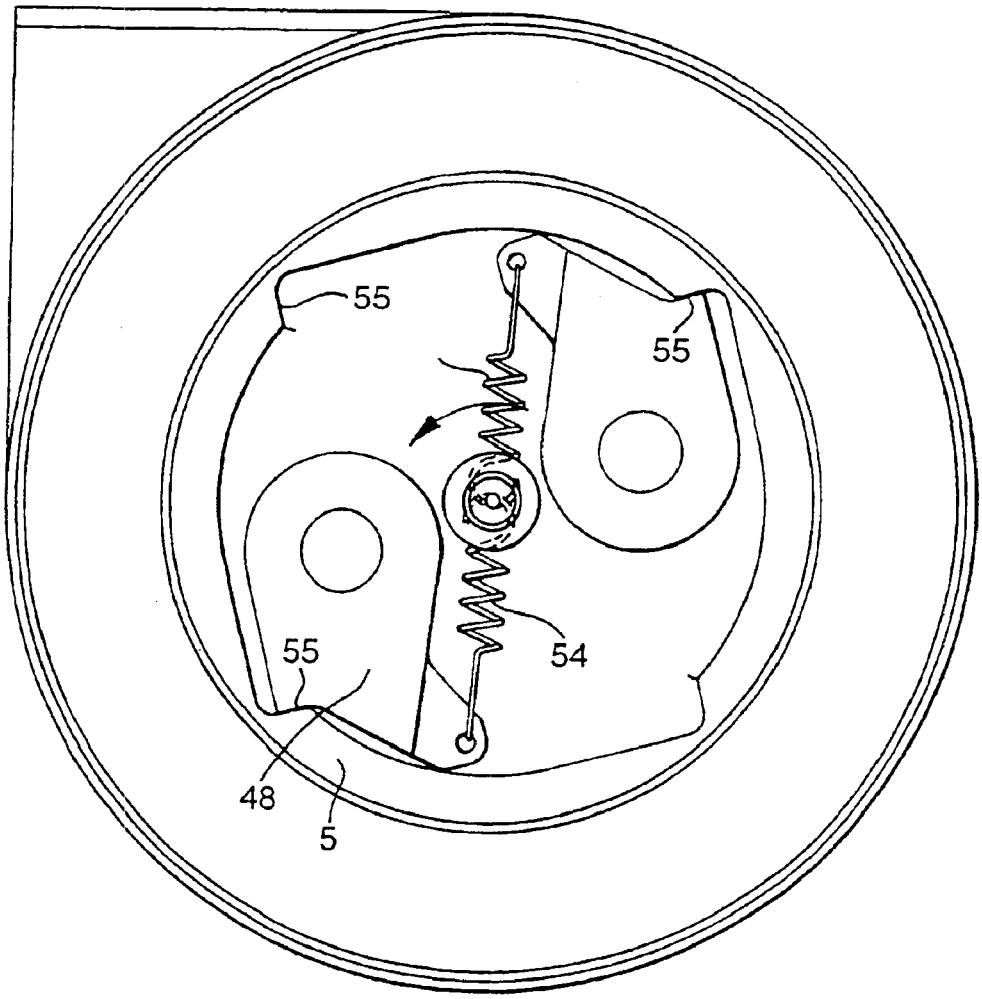

In view of the importance attached to successful operation of the snatch function, a secondary mechanism is incorporated within the reel assembly, so that failure of the latch to prevent rotation of the reel during load release, is rapidly backed up by alternative locking of the reel via a centrifugally energised pair of sears (48) which lock the reel to the housing cover (5) when the reel rotates at some predetermined velocity. During load ejection, large accelerations are encountered, so a downward velocity of (say) 0.4 m/sec would be achieved within 5 mm of downward motion of the load. This corresponds to a rotational velocity of the reel of approximately 250 rpm, which would be ample to operate the centrifugal brake. The sears are normally held out of engagement with the housing, by springs (54). FIG. 7 shows the sears disengaged from the housing cover, allowing rotation of the reel; whereas FIG. 9 shows the sears engaged with abutment faces (55) in the cover (5), thereby preventing rotation of the reel.

In its preferred forms, use of the invention may include the following advantages:

a) It may provide a single adjustable strong-point for the snatch connector lanyard.

b) It preferably applies a continuous but moderate tension to the snatch connector lanyard.

c) It enables the wiring harness to be attached to the load without disconnecting the snatch lanyard from the anchor-point.

d) It preferably ensures that the snatch tension in the connector lanyard is minimised.

e) It may help to ensure that the anchor-point is as far away from the load as possible, thereby reducing the amount by which the wiring harness is pulled out from its stowed position during load release, and reducing risk of damage to both the harness and its surrounding structure.

f) It advantageously withdraws the harness as far as possible back to its stowed position after load release.

g) It may help to achieve foolproof operation by encouraging only the correct sequence of actions.

h) It may provide a back-up operation mode in the event of primary latch failure.

What is claimed is:

1. A snatch disconnection assembly for use with a lanyard, the assembly comprising a tensioner, which in use has first and second operational modes, the tensioner comprising setting means for (a) allowing paying out of the lanyard in the first operational mode and (b) allowing pulling in of the lanyard while resisting paying out of the lanyard in the second operational mode, thereby providing a tensile force for snatch disconnection.

2. An assembly as defined in claim 1 whereby when the tensioner is set to allow paying out the lanyard, pulling in of the lanyard by the tensioner is resisted.

3. An assembly as defined in claim 1 further comprising a tensioning cable attached to or comprising the lanyard.

4. An assembly according to claim 3 in which the tensioner further comprises a springy-biased reel and whereby when in use, the tensioning cable is wound up onto and unwound from the reel which is spring biased to wind up the cable.

5. An assembly according to claim 4 in which the setting means comprises a first ratchet mechanism which can be set to resist rotation of the reel in the unwinding direction, thereby resisting paying out of the lanyard, but additionally and alternatively can be reset to resist rotation of the reel in the winding up direction, thereby allowing paying out of the lanyard and resisting pulling in of the lanyard while a snatch connection is made up.

6. An assembly according to claim 5 further comprising a second ratchet mechanism, whereby the assembly is biased towards the set condition and is moved to the reset condition by rotation of a key inserted into the assembly, counter rotation of the inserted key being resisted by the second ratchet mechanism.

7. An assembly according to claim 1 further comprising a brake operable to resist paying out of the lanyard at above a predetermined speed.

8. An assembly according to claim 1 further comprising a resilient link connected to the lanyard, opposed parts of the link each carrying abutment faces, the respective abutment faces on either side being brought into contact with each other when the link has been deformed by a predetermined amount.

9. An assembly as defined in claim 8 in which the abutments, when in contact, transmit tensile loads applied to opposed parts of a connector.

10. A snatch disconnection assembly for use with a lanyard, the assembly comprising:

a. a tensioner which in use has first and second operational modes, the tensioner comprising setting means for (i) allowing paying out of the lanyard in the first operational mode and (ii) allowing pulling in of the lanyard while resisting paving out of the lanyard in the second operational mode, thereby providing a tensile force for snatch disconnection, the setting means comprising a spring-biased reel;

b. a tensioning cable attached to or comprising the lanyard and which may be wound up onto and unwound from the reel which is spring biased to wind up the cable;

c. a mounting bracket;

d. a housing for the reel; and e. a flexible conduit extending between the bracket and the housing and through which the tensioning cable runs.

11. A snatch disconnection lanyard assembly comprising (a) a lanyard having a plurality of ends attached to a connector half at spaced circumferential locations, (b) a tensioner adapted to be set to allow paying out of the lanyard or set to pull in the lanyard and when set to pull in, will resist paying out of the lanyard, thereby providing a tensile force for snatch disconnection, and (c) a resilient link connected to the lanyard, opposed parts of the link each carrying abutment faces, the respective abutment faces on either side being brought into contact with each other when the link has been deformed by a predetermined amount, the link comprising a spreader bar connected between a tensioning cable and the lanyard.

* * * * *